US008479909B2

(12) United States Patent
King et al.

(10) Patent No.: US 8,479,909 B2
(45) Date of Patent: Jul. 9, 2013

(54) COIN VALIDATION UNIT WITH CLIP FEATURE

(75) Inventors: David William King, Rancho Santa Fe, CA (US); Alexander Schwarz, San Diego, CA (US)

(73) Assignee: IPS Group Inc., Rancho Santa Fe, CA (US)

( * ) Notice: Subject to any disclaimer, the term of this patent is extended or adjusted under 35 U.S.C. 154(b) by 787 days.

(21) Appl. No.: 12/059,899

(22) Filed: Mar. 31, 2008

(65) Prior Publication Data

US 2009/0095593 A1 Apr. 16, 2009

Related U.S. Application Data

(60) Provisional application No. 60/909,241, filed on Mar. 30, 2007.

(51) Int. Cl.
*G07D 7/00* (2006.01)

(52) U.S. Cl.
USPC ..... 194/302; 194/353; 194/900; 194/344; 194/350; 312/223.1; 312/223.2; 361/679.01; 361/679.02

(58) Field of Classification Search
USPC ..... 194/352, 206, 207, 302, 350, 353; 361/679.02, 679.01, 679.31–679.33, 679.37–679.39, 724–735, 740, 741, 747; 312/223.1, 223.2; 209/534
See application file for complete search history.

(56) References Cited

U.S. PATENT DOCUMENTS

| | | | | |
|---|---|---|---|---|
| 2,161,046 | A | | 6/1939 | Hitzeman |
| 2,832,506 | A | | 4/1958 | Hatcher |
| 2,988,191 | A | * | 6/1961 | Grant ..... 194/352 |
| 4,812,805 | A | | 3/1989 | Lachat et al. |
| 4,823,928 | A | | 4/1989 | Speas |
| 4,825,425 | A | | 4/1989 | Turner |
| 4,875,598 | A | | 10/1989 | Dahl |
| 4,880,097 | A | | 11/1989 | Speas |
| 5,065,156 | A | | 11/1991 | Bernier |
| 5,222,076 | A | | 6/1993 | Ng et al. |
| 5,244,070 | A | | 9/1993 | Carmen et al. |
| 5,273,151 | A | | 12/1993 | Carmen et al. |
| 5,360,095 | A | | 11/1994 | Speas |

(Continued)

FOREIGN PATENT DOCUMENTS

| | | |
|---|---|---|
| CA | 2377010 | 12/2001 |
| EP | 0980055 | 2/2000 |

(Continued)

OTHER PUBLICATIONS

U.S. Appl. No. 13/786,387, filed Mar. 5, 2013, David William King.

(Continued)

*Primary Examiner* — Jeffrey Shapiro
(74) *Attorney, Agent, or Firm* — Wilson, Sonsini, Goodrich & Rosati

(57) ABSTRACT

A separate removable and replaceable coin validation unit for use in a coin-operated device has a housing and clip formations by means of which the housing is releasably held in a cavity in the coin-operated device. The coin validation unit is electrically operable and has electrical connectors which connect with complementary connectors in the cavity. The coin operated device is particularly a single bay parking meter.

17 Claims, 3 Drawing Sheets

U.S. PATENT DOCUMENTS

| | | | | |
|---|---|---|---|---|
| 5,442,348 | A | 8/1995 | Mushell | |
| 5,563,491 | A | 10/1996 | Tseng | |
| 5,614,892 | A | 3/1997 | Ward, II et al. | |
| 5,617,942 | A | 4/1997 | Ward et al. | |
| 5,648,906 | A | 7/1997 | Amirpanahi | |
| 5,659,306 | A | 8/1997 | Bahar | |
| 5,806,651 | A | 9/1998 | Carmen et al. | |
| 5,833,042 | A | 11/1998 | Baitch et al. | |
| 5,841,369 | A | 11/1998 | Sutton et al. | |
| 5,842,411 | A | 12/1998 | Johnson | |
| 5,852,411 | A | 12/1998 | Jacobs et al. | |
| 5,954,182 | A * | 9/1999 | Wei | 194/345 |
| 6,111,522 | A | 8/2000 | Hiltz et al. | |
| 6,116,403 | A | 9/2000 | Kiehl | |
| 6,195,015 | B1 * | 2/2001 | Jacobs et al. | 340/693.9 |
| 6,229,455 | B1 | 5/2001 | Yost et al. | |
| 6,230,868 | B1 | 5/2001 | Tuxen et al. | |
| 6,309,098 | B1 | 10/2001 | Wong | |
| 6,312,152 | B2 | 11/2001 | Dee et al. | |
| 6,456,491 | B1 * | 9/2002 | Flannery et al. | 361/679.33 |
| 6,457,586 | B2 | 10/2002 | Yasuda et al. | |
| 6,505,774 | B1 | 1/2003 | Fulcher et al. | |
| 6,747,575 | B2 | 6/2004 | Chauvin et al. | |
| 6,856,922 | B1 | 2/2005 | Austin et al. | |
| 6,914,411 | B2 | 7/2005 | Couch et al. | |
| 6,929,179 | B2 | 8/2005 | Fulcher et al. | |
| 7,019,420 | B2 | 3/2006 | Kogan et al. | |
| 7,183,999 | B2 | 2/2007 | Matthews et al. | |
| 7,222,031 | B2 | 5/2007 | Heatley | |
| 7,237,716 | B2 | 7/2007 | Silberberg | |
| 7,388,349 | B2 | 6/2008 | Elder et al. | |
| 7,748,620 | B2 | 7/2010 | Gomez et al. | |
| 7,772,720 | B2 | 8/2010 | McGee et al. | |
| 7,854,310 | B2 | 12/2010 | King et al. | |
| 7,855,661 | B2 | 12/2010 | Ponert | |
| 2001/0012241 | A1 | 8/2001 | Dee et al. | |
| 2001/0047278 | A1 | 11/2001 | Brookner et al. | |
| 2001/0051531 | A1 | 12/2001 | Singhai et al. | |
| 2003/0092387 | A1 | 5/2003 | Hjelmvik | |
| 2003/0112597 | A1 * | 6/2003 | Smith | 361/685 |
| 2003/0121754 | A1 | 7/2003 | King | |
| 2003/0128010 | A1 | 7/2003 | Hsu | |
| 2003/0128136 | A1 | 7/2003 | Spier et al. | |
| 2003/0140531 | A1 * | 7/2003 | Pippins | 37/456 |
| 2003/0144972 | A1 | 7/2003 | Cordery et al. | |
| 2003/0179107 | A1 | 9/2003 | Kibria et al. | |
| 2004/0068434 | A1 | 4/2004 | Kanekon | |
| 2004/0084278 | A1 | 5/2004 | Harris et al. | |
| 2004/0181496 | A1 | 9/2004 | Odinotski et al. | |
| 2004/0264302 | A1 | 12/2004 | Ward | |
| 2005/0178639 | A1 * | 8/2005 | Brumfield et al. | 194/350 |
| 2005/0192911 | A1 | 9/2005 | Mattern | |
| 2006/0021848 | A1 * | 2/2006 | Smith | 194/350 |
| 2006/0116972 | A1 | 6/2006 | Wong | |
| 2006/0149684 | A1 | 7/2006 | Matsura et al. | |
| 2006/0152349 | A1 | 7/2006 | Ratnakar | |
| 2006/0267799 | A1 | 11/2006 | Mendelson | |
| 2007/0016539 | A1 | 1/2007 | Groft et al. | |
| 2007/0094153 | A1 | 4/2007 | Ferraro | |
| 2007/0114849 | A1 | 5/2007 | Falik et al. | |
| 2007/0119682 | A1 | 5/2007 | Banks et al. | |
| 2007/0136128 | A1 | 6/2007 | Janacek et al. | |
| 2008/0071611 | A1 | 3/2008 | Lovett | |
| 2008/0093454 | A1 | 4/2008 | Yamazaki et al. | |
| 2008/0238715 | A1 | 10/2008 | Cheng et al. | |
| 2008/0245638 | A1 | 10/2008 | King et al. | |
| 2009/0026842 | A1 | 1/2009 | Hunter et al. | |
| 2009/0032368 | A1 | 2/2009 | Hunter et al. | |
| 2009/0109062 | A1 | 4/2009 | An | |
| 2009/0159674 | A1 | 6/2009 | King et al. | |
| 2009/0183966 | A1 | 7/2009 | King et al. | |
| 2009/0192950 | A1 | 7/2009 | King et al. | |
| 2009/0284907 | A1 * | 11/2009 | Regimbal et al. | 361/679.02 |
| 2011/0057815 | A1 | 3/2011 | King et al. | |
| 2011/0060653 | A1 | 3/2011 | King et al. | |
| 2011/0203901 | A1 | 8/2011 | King et al. | |
| 2013/0027218 | A1 | 1/2013 | Schwarz et al. | |

FOREIGN PATENT DOCUMENTS

| | | |
|---|---|---|
| FR | 2837583 | 9/2003 |
| JP | 2002-099640 | 4/2002 |
| JP | 2005-267430 | 9/2005 |
| KR | 10-2005-0038077 | 4/2005 |
| WO | WO-2006-095352 | 9/2006 |
| WO | WO-2009-154787 | 12/2009 |

OTHER PUBLICATIONS

Cell Net Data Systems, "First Wireless Monitoring of Parking Meters Results in Theft Arrests Using CellNet Data Systems Technology," PRNewswire, May 11, 1999, 2 pgs.

Flatley. "In San Francisco, Hackers Park for Free," Read filed under Misc. Gadgets, downloaded from www.engadget.com website on May 3, 2010, originally posted on Jul. 31, 2009, 5 pages.

Meter Solutions, Single-Space Meters brochure, downloaded from www.duncansolutions.com website, revised Apr. 2006, 2 pages.

PCT/IB2006/054574 International Preliminary Report on Patentability dated Mar. 10, 2009.

PCT/IB2006/054574 International Search Report dated Oct. 27, 2008.

PCT/US2010/047906 International Pretitnimiry Report on Patentability dated Mar. 6, 2012.

PCT/US2010/047906 International Search Report dated Mar. 30, 2011.

PCT/US2010/047907 International Preliminary Report on Patentability dated. March 15, 2012.

PCT/US2010/047907 International Search Report dated Apr. 26, 2011.

PCT/US2012/048190 International Search Report dated Jan. 22, 2013.

* cited by examiner

COIN VALIDATION UNIT WITH CLIP FEATURE

This application claims the benefit of U.S. Provisional Application No. 60/909,241, filed Mar. 30, 2007, by King et al., entitled COIN VALIDATION UNIT, which is incorporated in its entirety herein by reference.

FIELD OF THE INVENTION

THIS INVENTION relates to a coin validation unit and a device having the coin validation unit.

SUMMARY OF THE INVENTION

According to a first aspect of the invention, there is provided a coin validation unit that is suitable for use in a coin-operated device, the unit including a housing; and clip formations for releasably clipping the housing in the coin-operated device.

It will be appreciated that the unit is then easily removed from, and inserted into, the device.

In an embodiment of the invention, the coin validation unit is electrically operable. In this embodiment, the coin validation unit has connectors that are electrically connectable to complementary connectors in the coin operated device.

The invention extends to a coin operated device which includes a coin validation unit in accordance with the invention. The body may have a cavity in which the coin validation unit is received. In the embodiment in which the coin validation unit is electrically operable, the body may have connectors complementary to those of the coin validation unit.

The invention extends still further to a coin-operated device which includes:

a body having a cavity in which a removable coin validation unit is receivable;

a removable coin validation unit in the cavity; and interoperable clip formations on the body and the coin validation unit.

Once again, with the electrically operable embodiment, the body and the coin validation unit may have connectable complementary connectors.

Preferably, the device is a parking meter, more specifically a single bay parking meter.

BRIEF DESCRIPTION OF THE DRAWINGS

Embodiments of the invention are now described, by way of example only and without limiting the scope of the invention, with reference to the accompanying figures, wherein.

DETAILED DESCRIPTION

Figure 1:
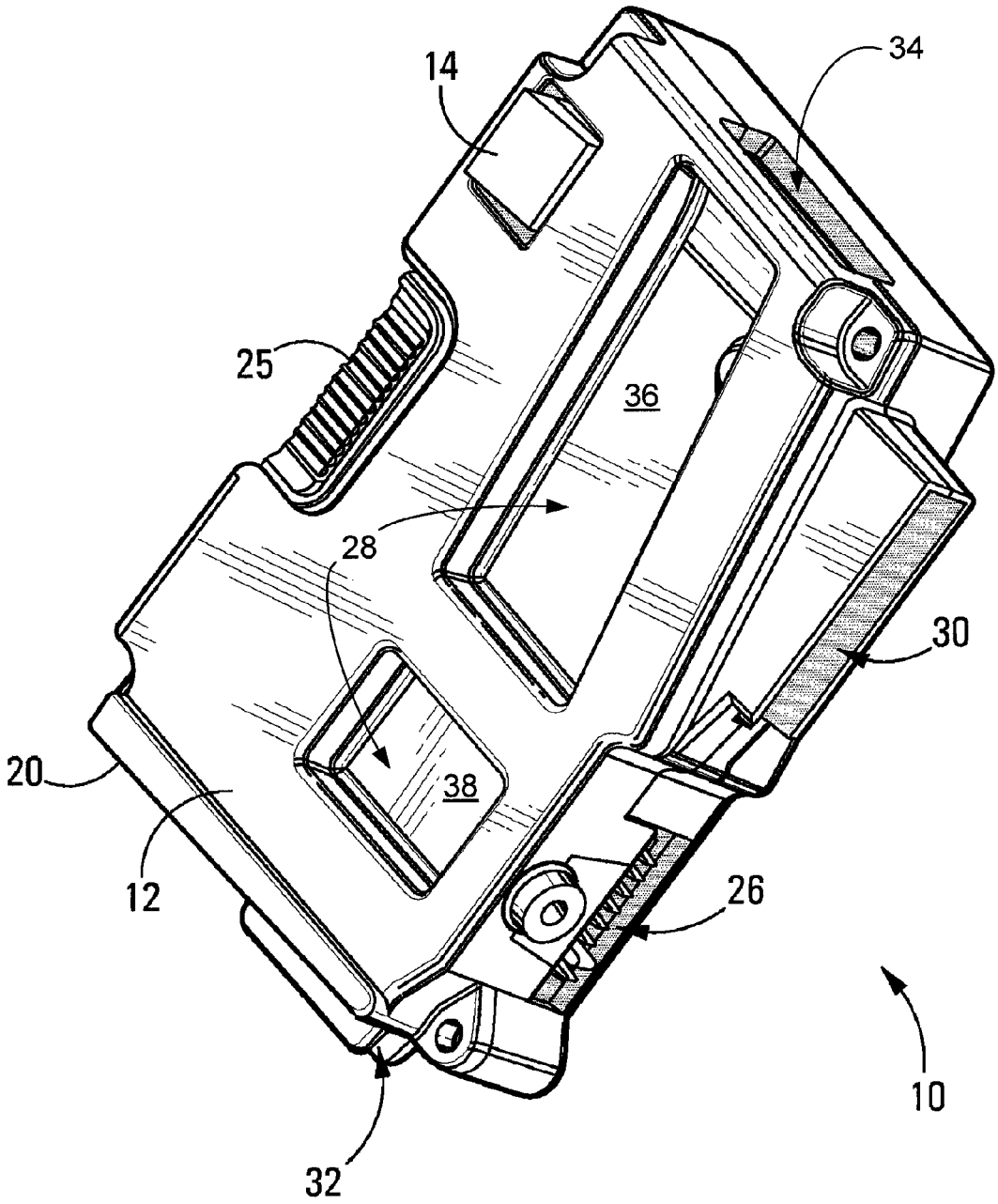
FIG. 1 is a perspective view of the coin validation unit.

In the accompanying figures, the coin validation unit is generally designated by reference numeral 10 and comprises a housing 12 and a pair of clip formations 14, which are arranged on opposite sides of the housing 12, and which clip formations 14 are used to clip the housing 12 releasably in a coin-operated device, in the fashion described below. The unit 10 has an internal validation pathway (not shown), with an entrance opening 30 and an outlet opening 32. A top opening 34 is located opposite the outlet opening 32. Side portions 36 and 38 indicated at 28 are shown in the drawing.

Figure 2:
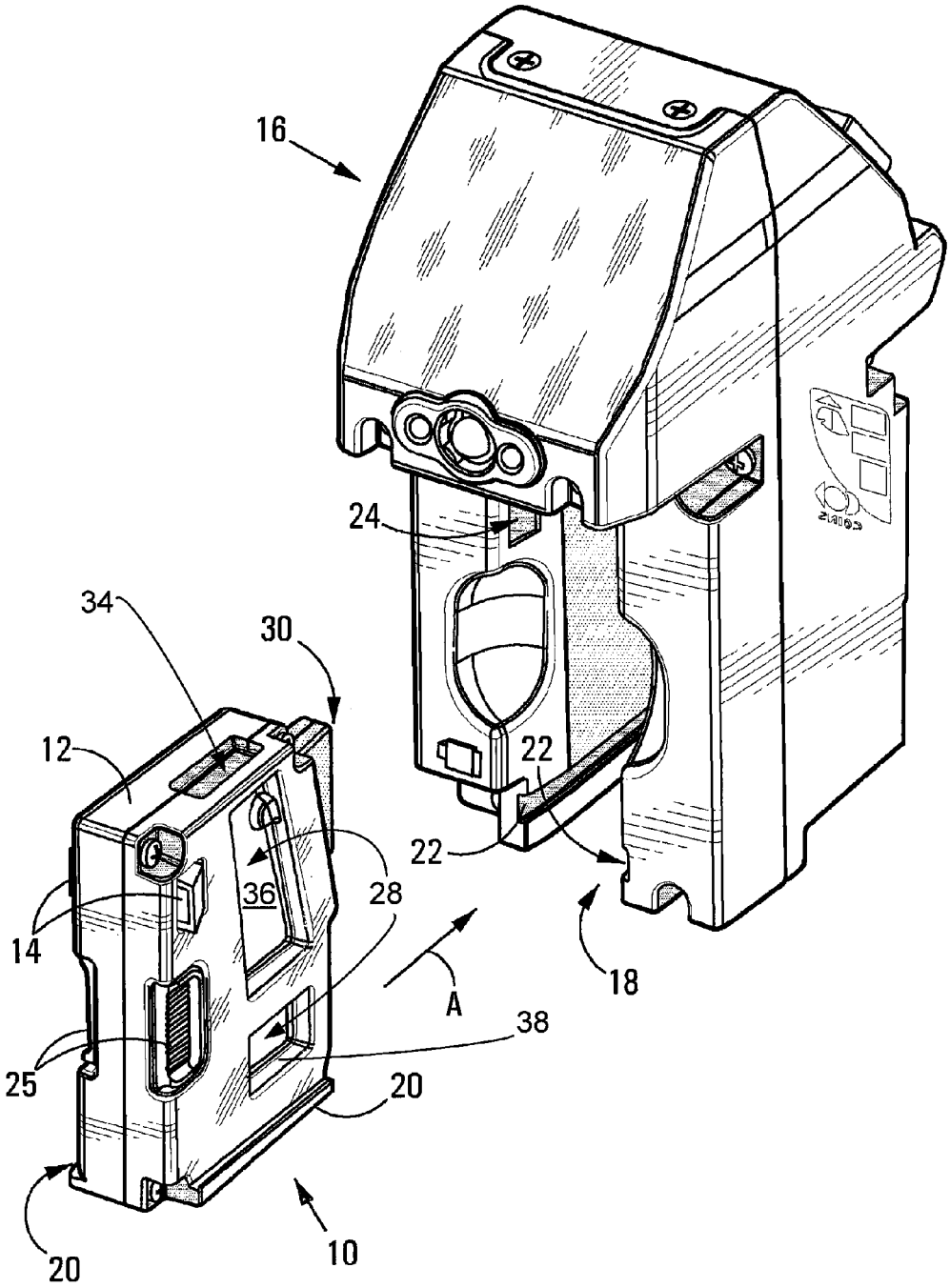
FIG. 2 is a perspective view of the coin validation unit, aligned for insertion into a parking meter.
Figure 3:
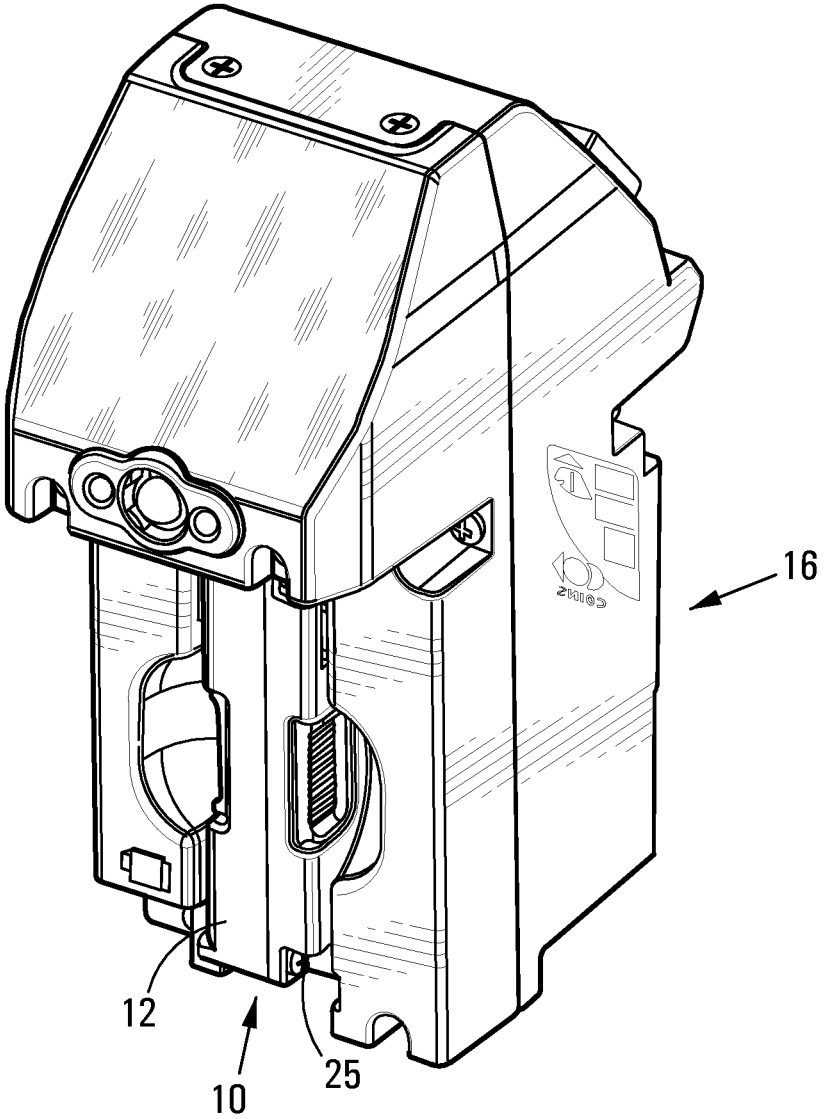
FIG. 3 is a perspective view of the coin validation unit when inserted fully into the parking meter.

The particular coin-operated device 16 depicted in FIGS. 2 and 3 is a parking meter. More specifically, the coin-operated device 16 is a single bay parking meter (ie a standalone parking meter). The parking meter 16 is constructed to include a cavity 18 for receiving the coin validation unit 10 therein, and the unit 10 is clipped snugly and releasably in the cavity 18 by virtue of the clip formations 14, as is described in greater detail below. The external shape and configuration of the housing 12 is designed to complement the internal dimensions of the cavity 18. For example, and as is depicted in FIG. 2, the unit 10 includes a pair of flanges 20, which flanges 20 are dimensioned and configured to be received within, and guided along, the corresponding grooves 22 that are provided in the cavity 18 of the parking meter 16.

Each of the clip formations 14 takes the form of a movable angled tooth, which is urged outwardly to project from the housing 12. In a preferred embodiment of the invention, the urging is achieved by means of an internal spring (not depicted). The parking meter 16 includes a pair of recesses 24 in the cavity 18 (Only one recess 24 is visible in FIG. 2. The other recess 24, which is obscured from view in this figure, is located directly opposite the recess 24 in view, in a symmetrical arrangement). Each recess 24 is dimensioned and configured to receive its associated tooth 14 therein when the unit 10 is inserted into the cavity 18. The teeth 24 are mechanically connected to, and movable by, buttons 25. In order to insert the unit 10 into the cavity 18, the user pushes the buttons 25 inwardly and against the urging force, so as to draw the teeth 14 at least partially within the housing 12. The unit 10 is then inserted into the parking meter 16, in the direction of arrow "A" and, when the teeth 14 are aligned with the recesses 24, the buttons 25 are released, causing the teeth 14 to revert to their urged positions in which they project outwardly from the housing 12, and each tooth 14 is held captive within its respective, associated recess 24. Instead, the unit 10 is pushed into the cavity 18, and the angled face of each tooth 14 slides against the wall of its associated recess 24 thus causing the teeth 24 to move inwardly until they are within their recesses 24, when they spring out again into locking positions. In order to remove the unit 10 from the cavity 18, the buttons 25 are pushed towards each other and against the urging force, so as to retract the teeth 14 into release positions within the housing 12 and free of the recesses 24, thus allowing the unit 10 to be slid from the cavity 18. It will be appreciated that the unit 10 is thus easily and selectively removed from, and inserted into, the parking meter 16. It will be appreciated that the device 16 has a coin entrance slot that aligns with the entrance opening 30 when the unit 10 is in the cavity 18.

In a preferred embodiment of the invention, the unit 10 is electrically operable, and includes a set 26 of electrical spade connectors, which connectors are dimensioned and configured to connect to a complementary set of electrical socket connectors (not depicted) that are located in the body of the parking meter 16.

The invention extends, too, to a coin operated device 16 which includes a coin validation unit 10 in accordance with the invention, as described above. This aspect of the invention is best depicted in FIG. 3.

The invention extends still further to a coin-operated device 16 which includes a body 12 having a cavity 18 in which a removable coin validation unit 10 is receivable; a removable coin validation unit 10 in the cavity 18; and interoperable clip formations 14 on the body 12 and the coin validation unit 10.

It will be appreciated by the person skilled in the art that application of this invention is not limited to parking meters only, but that this invention also has application to a multitude of coin-operated machines, including parking lot pay-point machines, vending machines, jukeboxes and laundromat washing machines.

What is claimed is:

1. A coin validation unit that is suitable for use in a coin-operated device, the unit including a housing that is configured to be received within a cavity of the coin-operated device, the housing comprising;

a front face having an upper angled portion including an entrance opening configured to receive coins, and a lower substantially vertical planar portion on which is located an electrical connector;

a rear face disposed opposite the front face and including a substantially planar surface having a left rear button recess disposed on a left portion and a right rear button recess disposed on a right portion, wherein the left and right rear button recesses are configured to accommodate left and right buttons, respectively;

a right plane having a substantially planar surface with a rear portion, having a right plane recess configured to accommodate the right button and a right clip formation that is disposed on the right plane rear portion above the right plane recess, the right plane further having a trapezoidal depression and a rectangular depression; and a left plane disposed opposite the right plane having a substantially planar surface with a rear portion having a left plane recess configured to accommodate the left button and a left clip formation that is disposed on the left plane rear portion above the left plane recess;

wherein the left and right buttons actuate the left and right clip formations, respectively, such that the left and right clip formations are released from an extended position when the left and right buttons are pressed toward each other;

wherein the entrance opening is configured to be aligned with a coin entrance slot of the coin-operated device when the coin validation unit is received within the cavity of the coin-operated device; and wherein a pair of flanges on opposite bottom edges of the housing are dimensioned and configured to be received within corresponding grooves of the coin-operated device when the coin validation unit is received within the cavity of the coin-operated device.

2. A coin validation unit as claimed in claim 1, which is electrically operable and which has a connector that is electrically connectable to a complementary connector in the coin operated device.

3. A coin operated device which includes a coin validation unit as claimed in claim 1.

4. A coin operated device as claimed in claim 3, which has a body with a cavity in which the coin validation unit is received.

5. A coin operated device which includes a coin validation unit as claimed in claim 3, and which has a complementary connector to the connector of the coin validation unit.

6. A coin operated device as claimed in claim 5, which has a body with a cavity in which the coin validation unit is received.

7. A coin operated device which includes a body having a cavity in which a removable coin validation unit is receivable;

a pair of semi-spherical recesses disposed on either side of the cavity configured to provide access to the removable coin validation unit;

a removable coin validation unit in the cavity;

the coin validation unit having a housing comprising;

a front face having an upper angled portion including a coin entrance slot configured to receive coins, and a lower planar portion including an electrical connector;

a rear face disposed opposite the front face and including a planar surface having a left recess disposed on the left portion and a right recess disposed on the right portion wherein the left and right recesses are configured to accommodate left and right buttons, respectively;

a right plane having a planar surface with a left portion having a recess configured to accommodate the right button and a right clip formation disposed on the planar surface above the recess, the planar surface further comprising a trapezoidal and a rectangular depression;

a left plane disposed opposite the right plane having a planar surface with a right portion having a recess configured to accommodate the left button and a left clip formation disposed on the planar surface above the recess; and wherein the left and right buttons are configured to actuate the left and right clip formations, respectively.

8. A coin operated device as claimed in claim 7, in which the coin validation unit is electrically operable and the coin validation unit and the body have complementary connectable connectors.

9. A coin operated device as in one of claims 3-8, which is a parking meter.

10. A coin operated device as claimed in claim 9, which is a single bay parking meter.

11. A coin validation unit as claimed in claim 1, further comprising a spring configured to urge the clip formations outward from the housing.

12. A coin operated device as claimed in claim 7, further comprising a spring configured to urge the clip formations outward from the coin validation unit.

13. A coin operated device as claimed in claim 7, wherein the body includes recesses configured to receive and engage the clip formations when the coin validation unit is received in the cavity.

14. A coin validation unit as claimed in claim 1, wherein the buttons are dimensioned and configured to align with semi-spherical recesses of the coin-operated device when the coin validation unit is received within the cavity of the coin-operated device.

15. A coin operated device as claimed in claim 7, wherein the buttons of the coin validation unit are dimensioned and configured to align with the semi-spherical recesses of the coin operated device body when the coin validation unit is received within the cavity of the coin operated device.

16. A coin validation unit as claimed in claim 1, wherein two protruding bosses are located on the lower substantially vertical planar portion, and wherein the upper angled portion transitions to the lower planar portion via an undercut portion.

17. A coin operated device as claimed in claim 7, wherein two protruding bosses are located on the lower substantially vertical planar portion, and wherein the upper angled portion transitions to the lower planar portion via an undercut portion.

* * * * *